US007733033B2

(12) United States Patent
Baaijens et al.

(10) Patent No.: US 7,733,033 B2
(45) Date of Patent: Jun. 8, 2010

(54) LIGHTING UNIT WITH MULTIPLE LIGHT SOURCES OF A DIFFERENT COLOR TEMPERATURE

(75) Inventors: Hans Baaijens, Eindhoven (NL); Willem Potze, Eindhoven (NL); David Copplestone Payne, Virginia Water (GB); Paul Philip Thursfield, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 332 days.

(21) Appl. No.: 11/909,628

(22) PCT Filed: Mar. 22, 2006

(86) PCT No.: PCT/IB2006/050886

§ 371 (c)(1), (2), (4) Date: Sep. 25, 2007

(87) PCT Pub. No.: WO2006/103600

PCT Pub. Date: Oct. 5, 2006

(65) Prior Publication Data

US 2009/0251066 A1 Oct. 8, 2009

(30) Foreign Application Priority Data

Mar. 31, 2005 (EP) ..... 05102540

(51) Int. Cl.
*H05B 37/02* (2006.01)

(52) U.S. Cl. ..... 315/292; 315/324

(58) Field of Classification Search ..... 315/291, 315/292, 307, 312, 313, 324, 362
See application file for complete search history.

(56) References Cited

U.S. PATENT DOCUMENTS

| | | | | |
|---|---|---|---|---|
| 6,603,271 | B2 * | 8/2003 | Noh | 315/185 S |
| 7,515,128 | B2 * | 4/2009 | Dowling | 345/83 |
| 2002/0047647 | A1 | 4/2002 | Noh | |
| 2006/0076908 | A1 * | 4/2006 | Morgan et al. | 315/312 |

FOREIGN PATENT DOCUMENTS

| | | |
|---|---|---|
| EP | 0574993 A1 | 12/1993 |
| WO | 0044205 | 7/2000 |

* cited by examiner

*Primary Examiner*—Thuy Vinh Tran

(57) ABSTRACT

In a lighting unit for operating lamps (LA1, LA2) of a different color temperature, a number of predetermined color points can be adjusted. The color points are chosen so that the color difference calculated in the CIELAB space is the same for subsequent adjustable color points.

12 Claims, 2 Drawing Sheets

LIGHTING UNIT WITH MULTIPLE LIGHT SOURCES OF A DIFFERENT COLOR TEMPERATURE

Figure 1:
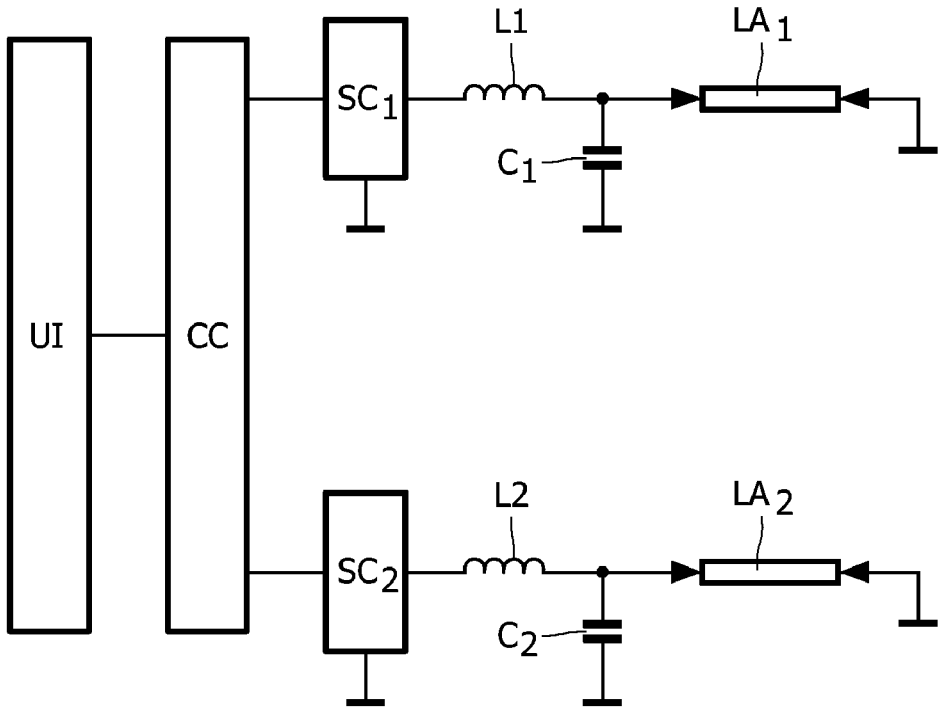

This Application is a National Phase Application filed under 35 U.S.C. 371 claiming the benefit of PCT/IB2006/050886 on Mar. 22, 2006, which has a priority based on EPO application No. EPO-05102540.1 filed on Mar. 31, 2005.

The invention relates to a lighting unit equipped with two light sources of a different color temperature and an operating circuit comprising

- a supply circuit for supplying currents to the two light sources,
- a control circuit for controlling the currents supplied by the supply circuit, and
- a user interface coupled to the control circuit for adjusting the color of the generated light at a number of predetermined color settings by means of adjusting the light outputs of the light sources.

Such a lighting unit is generally known. The light sources can for instance be fluorescent lamps of a different color temperature. The supply circuit may comprise one or more (dimmable) lamp ballasts, such as ballasts that supply a high frequency current to the lamps. Via the control circuit the currents supplied to the light sources are adjusted at a desired level. The current supplied to a light source determines the light output of the light source. Different color settings are realized via the user interface by adjusting the ratio of the light outputs of the two light sources. In this way the color of the light generated by the lighting unit can be varied over a range. Preferably, the light outputs of the light sources are chosen so that the total light output of the lighting unit, resulting from combining the light outputs of each of light sources, is maintained at the same level, when the color setting is changed.

The light output of each of the light sources can for instance be controlled by means of an adjustable digital number present in a memory comprised in the control circuit. The relation between the light output and the digital number can for instance be exponential (in case of the DALI standard) or linear (in case of the DMX standard). Subsequent predetermined color settings can in that case be realized by decreasing the digital number controlling the light output of one of the light sources by a constant amount and increasing the digital number controlling the light output of the other light source by the same amount.

A problem associated with this approach is that subsequent predetermined color settings correspond in part with color points that are perceived by the human eye as almost identical, and in part with color points that are perceived by a user as very different. To a user this is confusing and for this reason, a user cannot easily adjust the color of the light at a desired color.

The invention aims to provide a lighting unit that enables an untrained user to adjust the color of the light to a desired color in an easy way.

A lighting unit as mentioned in the opening paragraph is for that purpose characterized in that the color difference calculated in the CIELAB color space between a first color point corresponding to a first color setting and the nearest color point corresponding to a second color setting is the same for any first color point having the same value of the light output.

When a user of a lighting unit according to the invention adjusts the color of the light by activating subsequent predetermined color settings (and leaving the total light output unchanged), the perceived change in color is equal over the entire range wherein the color can be adjusted. As a consequence even an untrained user can easily find the predetermined color setting corresponding to the desired color.

Preferably the user interface of a lighting unit according to the invention is further equipped with means for via the control circuit adjusting the total light output of the lighting unit at a number of predetermined levels. These levels can be chosen such that the color difference calculated in the CIELAB space between color points corresponding to the same color setting and to successive levels of total light output is the same for each level of the light output.

The user interface can be equipped with a first push button for adjusting the color of the generated light at the predetermined color setting having the next higher value of the color temperature at every push and with a second push button for adjusting the color of the generated light at the predetermined color setting having the next lower value of the color temperature at every push. The user interface can be further equipped with a third push button for adjusting the total light output of the lighting unit at the next higher level at every push and with a fourth push button for adjusting the total light output of the lighting unit at the next lower level at every push.

Alternatively, the user interface can be equipped with a diamond shaped surface comprising a number of adjustment points where a user action is possible and wherein adjacent adjustment points in a first direction correspond to the same level of the light output and to different color settings and adjacent adjustment points in a second direction correspond to the same color setting and different levels of light output. A user action at an adjustment point activates the corresponding color setting or level of the light output. The adjustment points can be formed by push buttons. The diamond shaped surface can alternatively be formed by a touch pad. The user performs a user action by touching the touch pad in somewhere at its surface. To provide further help to a user, the diamond shaped surface can be equipped with a mapping of the adjustable colors.

The light sources in a lighting unit according to the invention are preferably formed by fluorescent lamps.

Figure 2:
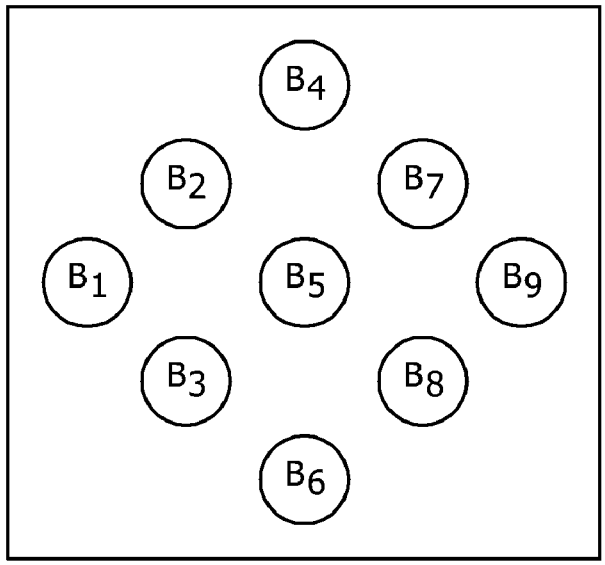
Figure 3:
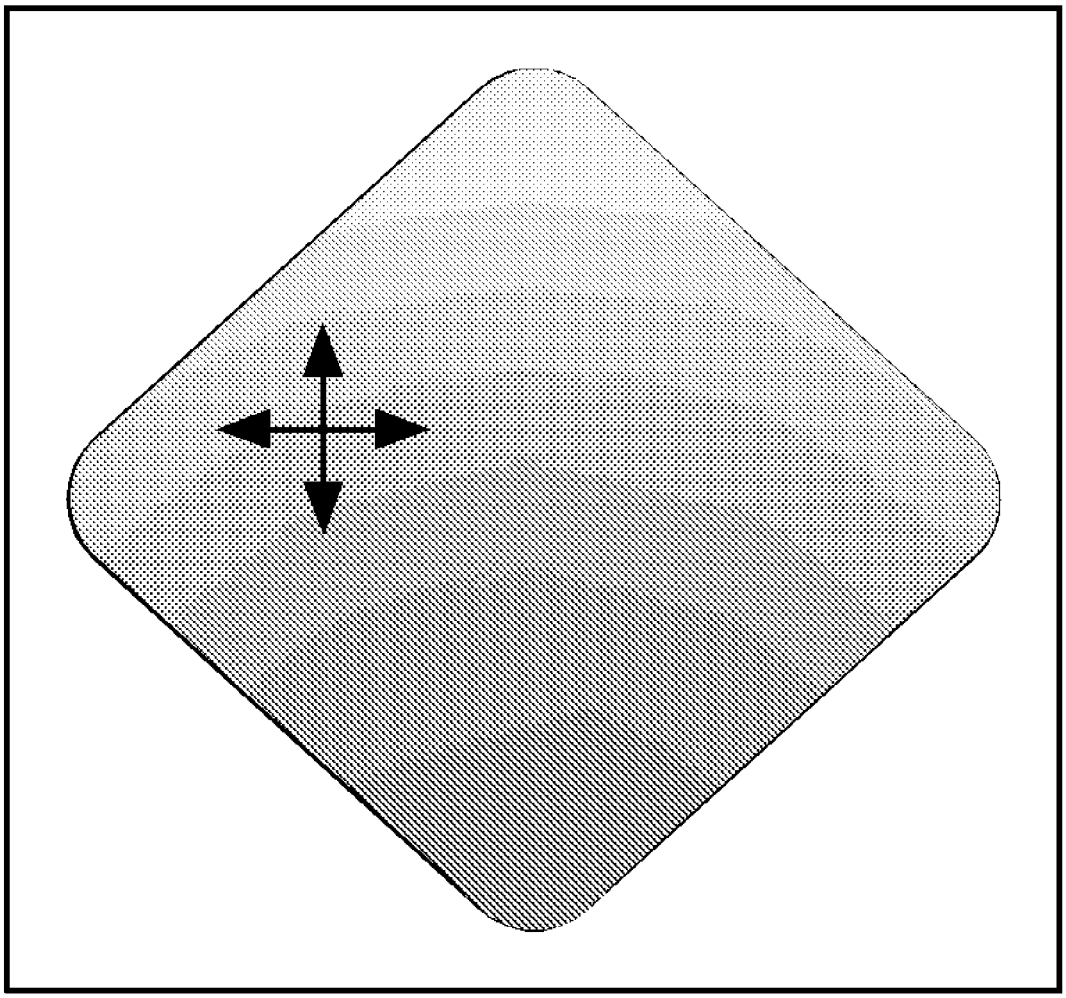

Embodiments of the invention will be further explained making reference to a drawing. In the drawing, FIG. 1 shows an embodiment of a lighting unit according to the present invention;

FIG. 2 shows an embodiment of a user interface for use in a lighting unit as shown in FIG. 1, and FIG. 3 shows a further embodiment of a user interface for use in a lighting unit as shown in FIG. 1.

In FIG. 1, LA1 and LA2 are fluorescent lamps of a different color temperature forming two light sources. Circuit part SC1 together with inductor L1 and capacitor C1 form an electronic lamp driver for supplying a high frequency current to fluorescent lamp LA1. Circuit part SC2 together with inductor L2 and capacitor C2 form an electronic lamp driver for supplying a high frequency current to fluorescent lamp LA2. The two electronic lamp drivers together form a supply circuit for supplying currents to the two lamps. Respective output terminals of circuit part CC are connected to an input terminal of circuit part SC1 and circuit part SC2 respectively. Circuit part CC forms a control circuit for controlling the currents supplied by the supply circuit. An input terminal of control circuit CC is connected to an output terminal of circuit part UI. Circuit part UI forms a user interface for adjusting the color of the generated light by means of adjusting the light outputs of the light sources. Circuit part UI is equipped with means for adjusting the color of the generated light at a number of predetermined color settings.

The operation of the lighting unit shown in FIG. 1 is as follows.

During stationary operation, the supply circuit SC1, SC2 supplies a lamp current to each of the fluorescent lamps LA1 and LA2. In the embodiment shown in FIG. 1, the light output of each of the fluorescent lamps can for instance be adjusted by adjusting the frequency of the current supplied to the lamp. In that case, each predetermined color setting is associated with two frequencies. These frequencies can for instance be stored in a memory. Circuit part UI can for instance be equipped with a microcontroller. When a user has selected one of the predetermined color settings, the microcontroller reads the corresponding frequencies from the memory and adjusts via circuit part CC the frequencies of the lamp currents at their proper value.

Every predetermined color setting corresponds to a color point in the CIELAB space. The CIELAB color space is described in detail in literature, e.g. "Principles of color technology" by R. Berns (2000). The CIELAB space is 3-dimensional and a color point is thus characterized by two parameters (such as hue and saturation) representing the color and a third parameter (such as brightness) representing the light level. These three parameters are the coordinates of the color point. To calculate these coordinates a reference color needs to be defined. This can for instance be the white color point at maximum light output. The color difference between two color points can be calculated as the Euclidean norm of the difference vector between the two color points in this space. The color settings are chosen such that the color differences between any color point and the color point(s) nearest to it in the CIELAB space is the same as long as these color points have the same level of light output. The important advantage of this is that a user can change the color of the light in a number of steps that are perceived as equidistant. In other words the change in color perceived by the user is identical for each step. This enables even an inexperienced user to easily find a desired color of the light.

It is noteworthy that apart from operating frequency, one or more other operational parameters can be used to adjust the light outputs of the lamps. It is for instance possible to modulate the amplitude of the lamp current with a square wave shape so that the amplitude of the current is zero during part of each modulation period and has a constant value differing from zero during the remaining part of each modulation period. The average light output of the lamp can be adjusted by adjusting the duty cycle of the modulation. Similarly, instead of fluorescent lamps, different light sources such as LEDs or HID lamps can be used.

Circuit part UI is further equipped with means for via the control circuit CC adjusting of the light output of the lighting unit at a number of predetermined levels. It is remarked that the level of the light output can be adjusted by means of adjusting the same operational parameters as mentioned hereabove for color adjustment, e.g. current frequencies, duty cycle of the modulations of the lamp currents. The predetermined levels of light output are chosen such that the color difference calculated in the CIELAB space between color points corresponding to the same color setting and to successive levels of light output is the same for each level of the light output. As a consequence, a user adjusting the light output subsequently at successive levels, perceives a change in light output that is the same for each level of the light output. It has been found that also this makes it easier for an inexperienced user to adjust the desired color point.

It is remarked that the color difference calculated in the CIELAB space and thus the color change perceived by a user between two color settings can differ for different levels of the light output.

In FIG. 2, B1 to B9 are push buttons arranged in a diamond shape. Each push button is associated with a color point of the light generated by the lighting unit. Push buttons that are on the same horizontal line (such as B1, B5 and B9; B3 and B8; B2 and B7) correspond to color points with same level of light output and thus provide means for changing the color of the light while the level of the light output remains the same. Similarly, push buttons that are on the same vertical line (such as B4, B5 and B6; B2 and B3; B7 and B8) correspond to color points with the same color setting but a different level of the light output. They thus provide means for changing the level of the light output without changing the color of the light. The color points corresponding to the push buttons can for instance chosen so that when adjacent push buttons are subsequently pushed moving from left to right, the color of the light changes from cool to warm, while the light level is increased when adjacent push buttons are subsequently pushed along the vertical direction. The push buttons are mapped with colors representing the color points that can be adjusted. This mapping is indicated in FIG. 2 by means of different shades of gray.

FIG. 3, shows a touch pad that has a diamond shape. A user can adjust a certain color point by touching the touch pad in a certain place. Also in this case the relation between the color points corresponding to the different positions on the touch pad can be chosen so that touch points on a horizontal line correspond to color points with a different color setting but the same light output level, while touch points on a vertical line correspond to color points having the same color but a different light level. Also on this touch pad there is a mapping of colors representing the adjustable color points. This mapping is indicated in FIG. 3 by means of different shades of gray.

It be mentioned that other user interfaces can be used comprising a touch screen, a computer screen together with a mouse for selecting a color setting. The user interface can be coupled to the control circuit by means of wiring, but the coupling can also be by means of wireless communication by means of infrared radiation or RF. In the latter case a mobile phone can be used as the user interface. The touch screen, computer screen or a screen that is comprised in the mobile phone may be equipped with a color mapping and/or a diamond shaped surface.

The invention claimed is:

1. A lighting unit, comprising:

at least two light sources of a different color temperature;

an operating circuit, comprising:

a supply circuit for supplying currents to the two light sources, and a control circuit for controlling the currents supplied by the supply circuit; and a user interface coupled to the control circuit for adjusting the color of the generated light at a number of predetermined color settings by means of adjusting the light outputs of the light sources, wherein the color difference calculated in the CIELAB color space between a first color point corresponding to a first color setting and a nearest color point corresponding to a second color setting is the same for any first color point having the same value of the total light output, and wherein the user interface comprises:

a first push button for adjusting the color of the generated light at the predetermined color setting having the next higher value of the color temperature at every push and a second push button for adjusting the color of the generated light at the predetermined color setting having the next lower value of the color temperature at every push.

2. A lighting unit as claimed in claim 1, wherein the user interface further comprises means for adjusting the total light output of the lighting unit at a number of predetermined levels via the control circuit.

3. A lighting unit as claimed in claim 2, wherein the color difference calculated in the CIELAB space between color points corresponding to the same color setting and to successive levels of total light output is the same for each level of the total light output.

4. A lighting unit as claimed in claim 1, wherein the user interface further comprises:

a third push button for adjusting the total light output of the generated light at the next higher level at every push and a fourth push button for adjusting the total light output of the generated light at the next lower level at every push.

5. A lighting unit as claimed in claim 1, wherein the user interface further comprises a diamond-shaped surface comprising a number of adjustment points for facilitating a user action and wherein adjacent adjustment points in a first direction correspond to the same level of the total light output and to different color settings and adjacent adjustment points in a second direction correspond to the same color setting and different levels of total light output.

6. A lighting unit as claimed in claim 5, wherein the adjustment points are formed by push buttons.

7. A lighting unit as claimed in claim 5, wherein the diamond shaped surface is formed by a touch pad.

8. A lighting unit as claimed in claim 5, wherein the diamond shaped surface is equipped with a mapping of the adjustable colors.

9. A lighting unit, comprising:

at least two light sources of a different color temperature;

an operating circuit, comprising a supply circuit for supplying currents to the two light sources, a control circuit for controlling the currents supplied by the supply circuit, and a user interface coupled to the control circuit for adjusting the color of the generated light at a number of predetermined color settings by means of adjusting the light outputs of the light sources, wherein the color difference calculated in the CIELAB color space between a first color point corresponding to a first color setting and a nearest color point corresponding to a second color setting is the same for any first color point having the same value of total light output, wherein the user interface comprises a diamond-shaped surface comprising a number of adjustment points for facilitating a user action, and wherein adjacent adjustment points in a first direction correspond to the same level of the total light output and to different color settings and adjacent adjustment points in a second direction correspond to the same color setting and different levels of total light output.

10. A lighting unit as claimed in claim 9, wherein the adjustment points are formed by push buttons.

11. A lighting unit as claimed in claim 9, wherein the diamond-shaped surface is formed by a touch pad.

12. A lighting unit as claimed in claim 9, wherein the diamond-shaped surface is equipped with a mapping of the adjustable colors.

* * * * *